US005755584A

United States Patent [19]

Kodama et al.

[11] Patent Number: 5,755,584

[45] Date of Patent: May 26, 1998

[54] MOVABLE BOARD CONNECTOR AND CONNECTOR TERMINAL THEREFOR

[75] Inventors: Shinji Kodama; Keiichi Ozaki, both of Shizuoka, Japan

[73] Assignee: Yazaki Corporation, Tokyo, Japan

[21] Appl. No.: 787,312

[22] Filed: Jan. 24, 1997

[30] Foreign Application Priority Data

Feb. 16, 1996 [JP] Japan ..... 8-029694

[51] Int. Cl.[6] ..... H01R 9/09

[52] U.S. Cl. ..... 439/248

[58] Field of Search ..... 439/78, 82, 83, 439/246, 247, 248

[56] References Cited

U.S. PATENT DOCUMENTS 4,738,631 4/1988 Takahashi et al. ..... 439/246
4,909,748 3/1990 Kozono et al. ..... 439/247

FOREIGN PATENT DOCUMENTS 61-201288 12/1986 Japan .

*Primary Examiner*—Gary F. Paumen
*Assistant Examiner*—T. C. Patel
*Attorney, Agent, or Firm*—Morgan, Lewis & Bockius LLP

[57] ABSTRACT

A movable board connector which includes: connector terminals having electric contact portions at their respective front ends and board insertion portions to be inserted into a printed circuit board at their respective rear ends; a connector housing having reception chambers for receiving the electric contact portions, and spring members provided on its outer circumference; a cylindrical terminal cover having an insertion space through which the connector terminals are inserted, the terminal cover having a front end which contacts with a rear surface of the connector housing and having a rear end which contacts with the printed circuit board; and a cylindrical connector cover which receives the connecter housing and the terminal cover, and which has a rear end fixed to the printed circuit board.

5 Claims, 3 Drawing Sheets

MOVABLE BOARD CONNECTOR AND CONNECTOR TERMINAL THEREFOR

BACKGROUND OF THE INVENTION

1. Field of the Invention

The present invention relates to a movable board connector and a connector terminal therefor for connecting different fixed bodies such as printed circuit boards with each other, and particularly relates to a movable board connector and a connector terminal therefor which can absorb positional displacement between printed circuit boards or the like by movement of the connector.

2. Background

When printed circuit boards are connected through connectors, there may appear positional displacement between the connectors due to relative positional displacement between the printed circuit boards. A movable board connector, by which such positional displacement can be absorbed, for connecting printed circuit boards with each other is, disclosed, for example, in Unexamined Japanese Utility Model Publication No. Sho. 61-201288.

FIG. 5 is an exploded perspective view illustrating a conventional movable board connector, and FIG. 6 is a sectional view illustrating a fitting state of the movable board connector and a printed circuit board. In this conventional example, a connector terminal 1 is formed of a band-like conductor plate 3, and an electric contact portion 5 for a terminal of a partner connector is provided at one end of the conductor plate 3 while a board insertion portion 11 to an insertion hole 9 of a printed circuit board 7 is provide at the other end. The bent portion between the horizontal portion and vertical portion of the conductor plate 3 is formed as a curved portion 13 for absorbing vertical positional displacement of the connector terminal. In addition, a U-shaped reinforcing wall 15 is formed in the vertical portion of the conductor plate 3 while a curved portion 17 is provided near the upper part thereof.

A housing 19 has a plurality of reception chambers 21 for receiving respective electric contact portions 5 of such connector terminals 1, and a board fitting portion 25 having a hole 23.

A fixed body 29 has a plurality of positioning holes 31 to which the board insertion portions 11 and the reinforcing walls 15 of the connector terminals 1 are inserted, and a fitting hole 33 for the printed circuit board 7. As shown in FIG. 6, this fitting hole 33 is a stepped hole the upper half of which is made to be a large-diameter portion.

Metal fittings 35 inserted to the hole 23 are fixed from the back of the printed circuit board 7 by a machine screw 37 so as to support the board fitting portion 25 on the printed circuit board 7. The head of the metal fittings 35 contacts with the stepped hole 33 so as to fix the fixed body 29 to the printed circuit board 7. At this time, the metal fittings 35 is loosely fitted to the hole 23 so as to support the board fitting portion 25 to the fixed body 29 movably.

By soldering the board insertion portions 11 projecting over the lower surface through the insertion hole 9 of the printed circuit board 7, the connector terminals 1 are electrically connected to a not-shown board circuit.

In a movable board connector 41 having such a configuration, the housing 19 moves relatively to the printed circuit board 7 if there is very small positional displacement between the movable board connector 41 and a not-shown partner connector when the movable connector 41 is connected to the partner connector. With movement of this housing 19, an external force is exerted to the connector terminals 1, but this external force is absorbed by the curved portions 13 and 17.

Since the external force caused by the movement of the housing 19 is thus absorbed by the curved portions 13 and 17, the movable board connector 41 can ensure a stable state of electric connection without giving any influence of the external force on the electric contact portions 5.

In the aforementioned movable board connector 41 in which the curved portions 13 and 17 of the connector terminals 1 are bent to absorb the external force when the housing 19 moves, however, the board insertion portions 11 of the connector terminals 1 are fixed to the printed circuit board 7 by soldering so that a counterforce at that time is transmitted to the solder-fixed portions to cause a chance to produce solder cracks.

In addition, because the housing 19 can move also in the fitting direction (the direction of arrow Z), a force generated when the connector is fitted is given to the connector terminals 1 directly to thereby cause a chance to deform the connector terminals 1 when the fitting force is too large.

Further, the difference in degree of heat deformation between the fixed body 29 and the printed circuit board 7 produces positional displacement between the fixed body 29 and the printed circuit board 7 in soldering, and this stress acts on the solder-fixed portions to thereby cause a chance to produce solder cracks.

SUMMARY OF THE INVENTION

It is therefore an object of the present invention to solve the foregoing problems.

It is another object of the invention to provide a movable board connector and a connector terminal therefor in which no stress acts on solder-fixed portions or electric contact portions at the time of absorbing positional displacement, fitting, and heat deformation to thereby prevent occurrence of solder cracks, and improve the reliability of the contact portions.

In order to attain the foregoing objects, the configuration of a movable board connector according to the present invention includes: connector terminals having electric contact portions at their respective front ends and board insertion portions to be inserted into a printed circuit board at their respective rear ends; a connector housing having reception chambers for receiving the electric contact portions, and spring members provided on its outer circumference; a cylindrical terminal cover having an insertion space through which the connector terminals are inserted, the terminal cover having a front end which contacts with a rear surface of the connector housing and having a rear end which contacts with the printed circuit board; and a cylindrical connector cover which receives the connecter housing and the terminal cover, and which has a rear end fixed to the printed circuit board.

In the movable board connector, preferably, substantially central portions of the connector terminals may be fixed to the terminal cover in the insertion space.

The connector terminal according to the present invention has a configuration in which the connector terminal has a conductor plate which includes: an electric contact portion provided at a front end of the conductor plate; a board insertion portion provided at a rear end of the conductor plate; first and second movable portions which are easily elastically deformable and which are formed between the electric contact portion and the board insertion portion; and a fixation portion formed between the first and second movable portions.

In the connector terminal, preferably, the first and second movable portions are formed by making partially narrow a width of the conductor plate which is shaped like a band.

In the thus configured movable board connector, the connector terminal is attached to the connector housing provided with the spring member on its outer circumference, and this connector housing is received in the connector cover movably, so that an external force generated by the movement of the connector housing is borne on the spring member. In addition, the rear surface of the connector housing contacts with the terminal cover, so that the movement of the connector housing is restricted when a partner connector is fitted.

In addition, when the approximately central portion of the connector terminal is fixed to the terminal cover in the insertion space, an external force generated at the time of movement for positioning is borne on the terminal cover in the insertion space.

In the connecter terminal according to the present invention, the fixation portion is fixed to the terminal cover, so that an external force generated at time of movement for positioning can be absorbed by the first movable portion. In addition, a force caused by heat deformation in soldering and fixing is absorbed by the second movable portion.

If a band-like conductor plate is made narrow partially, the first and second movable portions low in rigidity and easy of elastic displacement can be obtained.

DETAILED DESCRIPTION OF THE PREFERRED EMBODIMENT

Preferred embodiments of a movable board connector and a connector terminal therefor according to the present invention will be described below in detail with reference to the drawings.

Figure 1:
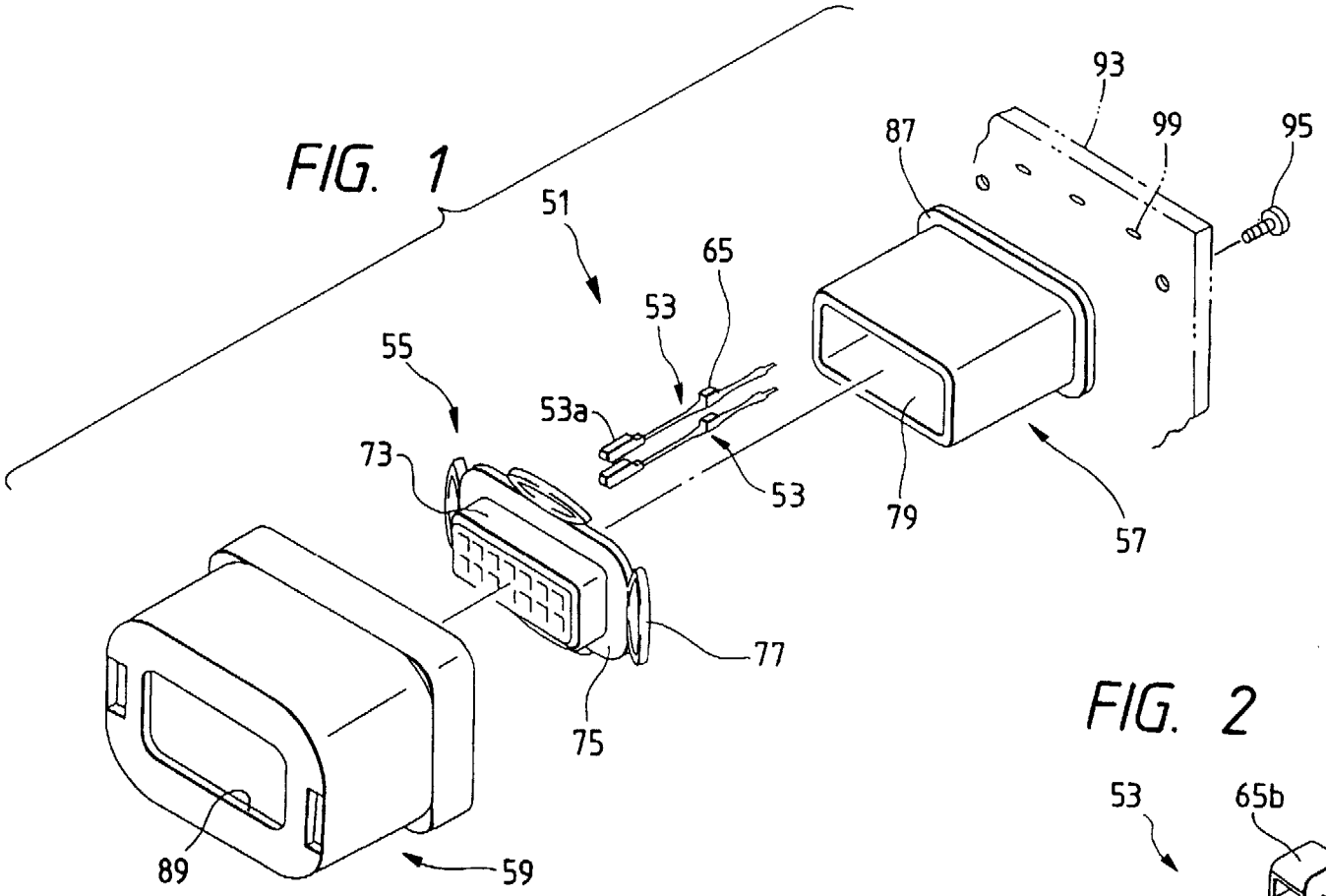
FIG. 1 is an exploded perspective view of a movable board connector according to the present invention.

As shown in FIG. 1, a movable board connector (hereinafter abbreviated to "movable connector") 51 includes connector terminals 53, a connector housing 55 for receiving electric contact portions 53*a* of the connector terminals 53, a terminal cover 57 penetrated by the central portions of the connector terminals 53, and a connector cover 59 for receiving the connector housing 55 and the terminal cover 57.

Figure 2:
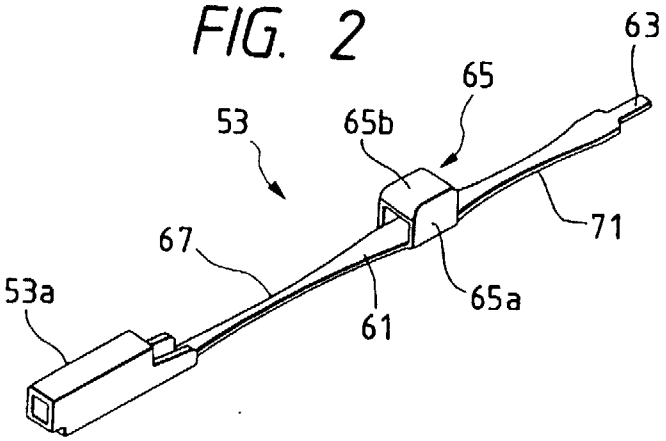
FIG. 2 is an expanded perspective view of a connector terminal shown in FIG. 1.

As shown in FIG. 2, each of the connector terminals 53 is formed of a band-like conductor plate 61 and has an electric contact portion 53*a* at its front end, and a board insertion portion 63 at its rear end. In addition, the connector terminal 53 has a fixation portion 65 in its central portion. The fixation portion 65 is formed, for example, by raising the opposite sides of the conductor plate 61 as standing pieces 65*a*, and coupling the upper ends of the standing pieces 65*a* with each other through a fixation plate 65*b*.

The connector terminal 53 has a first movable portion 67 between the electric contact portion 53*a* and the fixation portion 65. The width of the first movable portion 67 is made narrow by making the opposite sides of the conductor plate 61 be curved so as to come close to each other. In addition, the connector terminal 53 has a second movable portion 71 between the fixation portion 65 and the board insertion portion 63. Also the width of the second movable portion 71 is made narrow by making the opposite sides of the conductor plate 61 be curved so as to come to each other. The thus configured connector terminal 53 can be transformed easily, within the range of its elasticity, in the first movable portion 67 and the second movable portion 71.

The connector housing 55 has a plurality of terminal receiving chambers. The terminal receiving chambers lock the electric contact portions 53*a* of the connector terminals 53 by not-shown elastic lock pieces in the state where the elastic contact portions 53*a* are attached. The connector housing 55 has a collar portion 75 on the outer circumference of the fixing portion 73. The collar portion 75 has spring members 77 on the respective sides of its outer circumference. Each of the spring members 77 has such a structure that a pair of parallel plate springs having a gap at their center portion are coupled with each other at their opposite ends. The connector housing 55 is disposed so that the rear surface thereof contacts with the front surface of the terminal cover 57.

Figure 3:
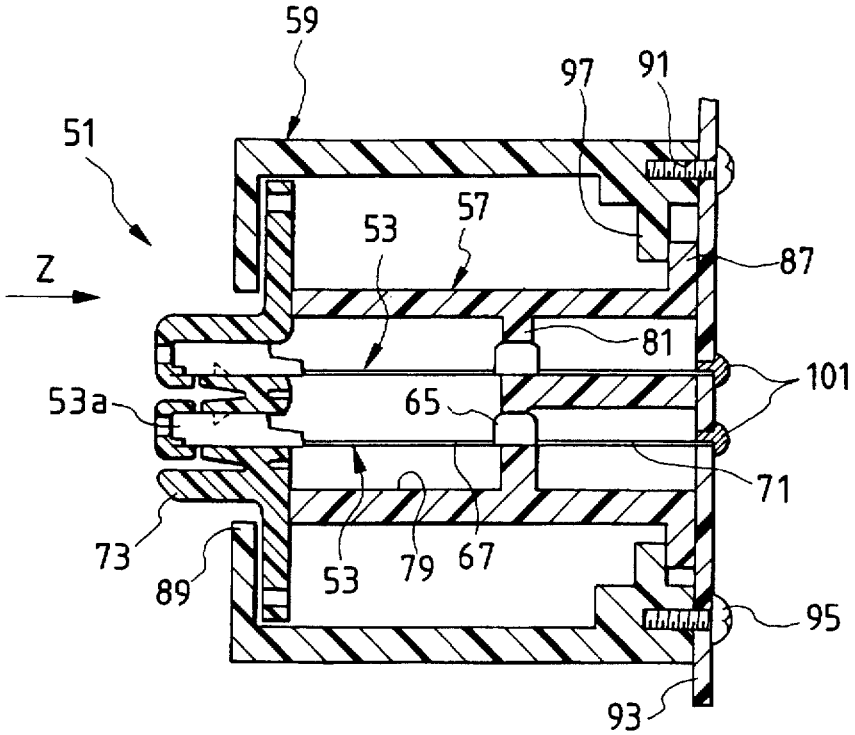
FIG. 3 is a longitudinal sectional view of the movable connector of FIG. 1 after assembled.

The cylindrical terminal cover 57 has an insertion space 79 for the connector terminals 53 in its inside. In addition, the terminal cover 57 has a terminal fixation portion 81 in the insertion space 79 as shown in FIG. 3. The terminal fixation portion 81 is formed, for example, by forming a fixation hole in a fixation plate formed in the insertion space 79. This terminal fixation portion 81 fixes the fixation portion 65 of the connector terminal 53 inserted thereto. The fixation is performed by an engagement structure, a bonding agent, or the like. In addition, the terminal cover 57 has a fixing flange portion 87 formed in the outer circumference of the rear end.

Figure 4:
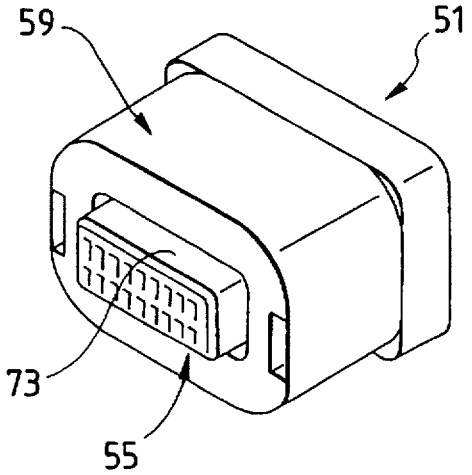
FIG. 4 is an assembly appearance perspective view of the movable connector shown in FIG. 1.
Figure 5:
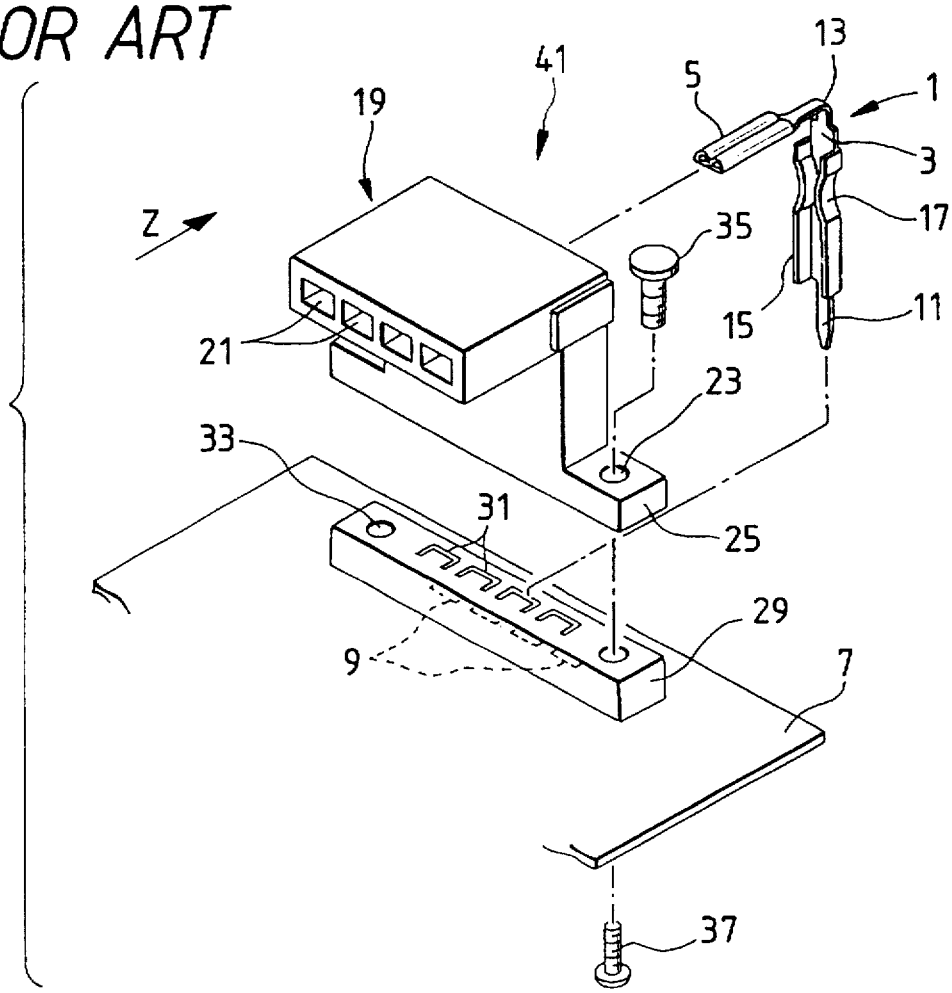
FIG. 5 PRIOR ART
FIG. 5 is an exploded perspective view illustrating a conventional movable board connector.
Figure 6:
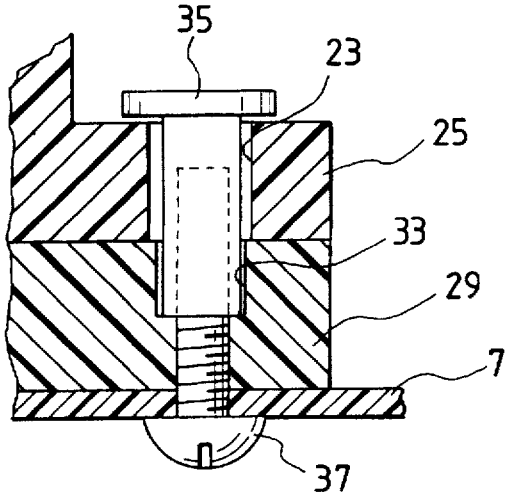
FIG. 6 PRIOR ART
FIG. 6 is a sectional view illustrating the fitting state of a movable board connector and a printed circuit board.

The cylindrical connector cover 59 can receive the connector housing 55 and the terminal cover 57 in its inside. The connector cover 59 has an opening portion 89 in its front end surface, and a fitting portion 73 of the connector housing 55 is made to project out through this opening portion 89 (see FIG. 4). The opening portion 89 is larger than the external size of the fitting portion 73. Therefore, the fitting portion 73 projecting out through the opening portion 89 can move in the opening portion 89 freely. The connector cover 59 has a tapped hole 91 (see FIG. 3) in its rear end surface. The tapped hole 91 engages with a fixation screw 95 penetrating a printed circuit board 93. The connector cover 59 has a fixation plate 97 in the inner circumference of its rear portion. Fixing the connector cover 59 to the printed circuit board 93, the fixation plate 97 holds the flange portion 87 of the terminal cover 57 together with the printed circuit board 93.

The assembly procedure of the movable connector 51 having such a structure will be described.

First, the electric contact portion 53*a* of the connector terminal 53 is attached to the connector housing 55. Next, the connector terminal 53 led out from the rear surface of the connector housing 55 is inserted into the insertion space 79 of the terminal cover 57 while the rear surface of the connector housing 55 is brought into contact with the front end of the terminal cover 57. In this state, the fixation portion 65 of the connector terminal 53 is fixed to the terminal fixation portion 81 of the terminal cover 57.

The connector cover 59 is inserted onto the connector housing 55 and the terminal cover 57 from the front side thereof so as to make the fitting portion 73 project out through the opening portion 89, and at the same time to bring the rear end of the connector cover 59 into contact with the printed circuit board 93. At this time, the board insertion portion 63 of the connector terminal 53 is inserted to a fixation hole 99 of the printed circuit board 93.

Next, the fixation screw 95 penetrating the printed circuit board 93 is screwed down to the tapped hole 91 of the connector cover 59 so as to fix the connector cover 59 to the printed circuit board 93. At this time, the flange portion 87 of the terminal cover 57 is held by the fixation plate 97 of the connector cover 59 and the printed circuit board 93 so as to fix the terminal cover 57 to the printed circuit board 93 at the same time. Last, the board insertion portion 63 of the connector terminal 53 is soldered with the fixation hole 99. Thus, the assembly of the movable connector 51 is completed.

The operation of the thus configured movable connector 51 will be described.

If there is very small displacement between a not-shown partner connector and the movable connector 51 when both the connectors are fitted to each other, the movable connector 51 moves in accordance with the fitting center of the partner connector and absorbs relative positional displacement between both the connectors.

At this time, the central portion of the connector terminal 53 is made to be in a fixed state by the fixation portion 65, so that an external force caused by the movement of the connector housing 55 is absorbed only by the transformation of the first movable portion 67.

Therefore, the external force caused by the movement of the connector housing 55 is not transmitted to a soldered portion 101 of the connector terminal 53.

At this time, the connector housing 55 moves against the spring force of the spring members 77 contacting with the inner circumference of the connector cover 59. Therefore, part of the external force acting on the connector housing 55 becomes a transformation force of the spring members 77, so that the external force given to the first movable portion 67 is reduced correspondingly. Consequently, vibrations or the like in which a comparatively small external force is repeated for a short time are attenuated.

In addition, since the rear surface of the connector housing 55 contacts with the terminal cover 57, there is no chance that the connector housing 55 moves in the direction of fitting to the partner connector (Z direction in FIG. 3) by an excessive fitting force of the partner connector, so that an external force in that direction acts on the connector terminal 53.

When relative positional displacement is caused by the difference in amount of heat deformation between the movable connector 51 and the printed circuit board 93 at the time of soldering and fixing, the connector terminal 53 absorbs a force caused by this positional displacement through the transformation of the second movable portion 71. Therefore, there is no chance that the force caused by the positional displacement acts on the solder-fixed portion 101 as counterforce.

Thus, in the aforementioned movable connector 51, the first and second movable portions 67 and 71 are provided in the connector terminal 53, and the fixation portion 65 provided therebetween is fixed to the terminal cover 57 while the connector housing 55 to which the electric contact portion 53*a* of the connector terminal 53 is to be mounted is provided movably through the spring members 77. Accordingly, an external force generated at the time of movement for positioning can be absorbed by the first movable portion 67 so that there is no chance to produce solder cracks in the solder-fixed portion 101.

Since the rear surface of the connector housing 55 contacts with the terminal cover 57, the fitting force of the partner connector prevents the connector housing 55 from moving, so that it is possible to prevent the connector terminal 53 from being deformed by the external force in the fitting direction, and the solder-fixed portion 101 from cracking.

In addition, the external force caused by the movement of the connector housing 55 can be borne on the spring members 77, so that it is possible to reduce an external force given to the connector terminal 53 correspondingly. As a result, it is possible to reduce a bad influence, particularly due to vibrations or the like, on the electric contact portions 53*a*.

Further, since the second movable portion 71 is provided in the connector terminal 53 between the movable connector 51 and the printed circuit board 93, a force caused by the difference in amount of heat deformation between the movable connector 51 and the printed circuit board 93 in soldering and fixing can be absorbed by the second movable portion 71, so that it is possible to prevent the solder-fixed portion 101 from cracking.

Although the connector terminal 53 is formed of a band-like conductor plate and the first and second movable portions 67 and 71 are made to have narrowed width in the above-mentioned embodiment, the first and second movable portions 67 and 71 may be formed in any other elastically absorbable form such as a corrugated bent spring, a coil spring, or the like.

As has been described in detail, in a movable board connector according to the present invention, connector terminals are attached to a connector housing having spring members provided in its outer circumference, and this connector housing is movably received in a connector cover. Accordingly, an external force caused by the movement of the connector housing can be borne on the spring members, so that it is possible to reduce a force given to the connector terminal correspondingly. In addition, the rear surface of the connector housing contacts with the terminal cover, so that it is possible to prevent the connector housing from moving when a partner connector is fitted. Accordingly, it is possible to prevent the connector terminals from being deformed by an external force in the fitting direction, and a solder-fixed portion from cracking.

In addition, if the approximately central portion of the connector terminal is fixed to the terminal cover in an insertion space, an external force generated at the time of movement for positioning can be borne on the terminal cover in the insertion space, and the external force can be prevented from being transmitted to the solder-fixed portion, so that it is possible to prevent solder cracks.

In the configuration of the connector terminal according to the present invention, since first and second movable portions are provided, and a fixation portion is provided between both the movable portions, an external force generated upon movement for positioning can be absorbed by the first movable portion while the fixation portion is fixed to the terminal cover. In addition, a force caused by heat deformation at the time of soldering and fixing can be absorbed by the second movable portion.

By making a band-like conductor plate narrow partially, the first and second movable portions can be formed so that they are elastically deformed easily.

What is claimed is:

1. A movable board connector, comprising:

connector terminals including electric contact portions at front ends thereof and board insertion portions to be inserted into a printed circuit board at rear ends thereof;

a connector housing including reception chambers for receiving said electric contact portions of said connector terminals, and spring members provided on an outer circumference thereof;

a cylindrical terminal cover including an insertion space through which said connector terminals are inserted, said terminal cover having a front end which contacts with a rear surface of said connector housing and having a rear end which contacts with said printed circuit board; and a cylindrical connector cover receiving said connector housing and said terminal cover, and having a rear end fixed to said printed circuit board, wherein said spring members allow lateral movement of said connector housing relative to said connector cover.

2. The movable board connector of claim 1, wherein substantially central portions of said connector terminals are fixed to said terminal cover in said insertion space.

3. The movable board connector of claim 1, wherein said connector terminals are made of conductor plate.

4. The movable board connector of claim 1, wherein said connector terminals each has first and second movable portions which are elastically deformable and which are formed between said electric contact portion and said board insertion portion, and a fixation portion formed between said first and second movable portions.

5. The movable board connector of claim 4, wherein said first and second movable portions have narrow width portions, respectively.

* * * * *